US010080471B2

(12) United States Patent
Reimer et al.

(10) Patent No.: US 10,080,471 B2
(45) Date of Patent: Sep. 25, 2018

(54) VERSATILE VACUUM CLEANERS

(71) Applicant: Electrolux Home Care Products, Inc., Charlotte, NC (US)

(72) Inventors: William Reimer, Charlotte, NC (US); Brad Hoare, Charlotte, NC (US); Craig Amick, Charlotte, NC (US)

(73) Assignee: Electrolux Home Care Products, Inc., Charlotte, NC (US)

( * ) Notice: Subject to any disclaimer, the term of this patent is extended or adjusted under 35 U.S.C. 154(b) by 230 days.

(21) Appl. No.: 14/976,817

(22) Filed: Dec. 21, 2015

(65) Prior Publication Data

US 2017/0172362 A1 Jun. 22, 2017

(51) Int. Cl.

| | |
|---|---|
| ***A47L 5/24*** | (2006.01) |
| ***A47L 5/22*** | (2006.01) |
| ***A47L 9/16*** | (2006.01) |
| ***A47L 9/24*** | (2006.01) |
| ***A47L 9/04*** | (2006.01) |

(52) U.S. Cl.

CPC ..... *A47L 5/225* (2013.01); *A47L 5/24* (2013.01); *A47L 9/0477* (2013.01); *A47L 9/1683* (2013.01); *A47L 9/244* (2013.01); *A47L 9/246* (2013.01)

(58) Field of Classification Search

CPC ..... A47L 5/225; A47L 5/24; A47L 9/0477; A47L 9/1683; A47L 9/244; A47L 9/246

See application file for complete search history.

(56) References Cited

U.S. PATENT DOCUMENTS

| | | | |
|---|---|---|---|
| 2,300,266 | A | 5/1939 | Smellie |
| 2,660,457 | A | 4/1950 | Mallon |
| 2,867,833 | A | 4/1955 | Duff |
| 4,050,113 | A | 9/1977 | Wright |

(Continued)

FOREIGN PATENT DOCUMENTS

| | | |
|---|---|---|
| CA | 2087056 | 7/1994 |
| DE | 19630286 | 1/1998 |

(Continued)

OTHER PUBLICATIONS

International Search Report and Written Opinion for International Application No. PCT/IB2016/001989, dated Jun. 1, 2017—14 Pages.

(Continued)

*Primary Examiner* — Robert Scruggs
(74) *Attorney, Agent, or Firm* — RatnerPrestia

(57) ABSTRACT

A vacuum cleaner with a vacuum unit and a wand assembly. The vacuum unit has a vacuum unit inlet. The wand assembly has a rigid portion and a flexible portion. The rigid portion has proximal and distal wand ends, and is reconfigurable between a condition in which the proximal wand end is rigidly connected to the vacuum unit inlet, and a condition in which the proximal wand end is movable relative to the vacuum unit inlet. The flexible portion has a proximal hose end to connect to the vacuum unit inlet, a distal hose end configured to fit inside the rigid portion, and a flexible hose between the hose ends. The hose is movable between a condition in which the hose is entirely inside the rigid portion, and a condition in which at least a portion of the hose adjacent the proximal hose end extends outside the rigid portion.

20 Claims, 8 Drawing Sheets

(56) References Cited

U.S. PATENT DOCUMENTS 4,373,228 A 2/1983 Dyson
4,393,536 A 7/1983 Tapp
4,473,923 A * 10/1984 Neroni ..... A47L 9/246 15/377
4,519,113 A 5/1985 Hipple
4,571,772 A 2/1986 Dyson
4,610,048 A 9/1986 Ishihara et al.
D290,894 S 7/1987 Miyamoto
4,704,765 A 11/1987 Ataka
4,955,106 A 9/1990 Stein
5,309,600 A 5/1994 Weaver
5,379,483 A 1/1995 Pino
5,500,979 A 3/1996 Worwag
5,524,321 A 6/1996 Weaver
5,584,436 A 12/1996 Sepke
5,715,566 A 2/1998 Weaver
5,797,162 A 8/1998 Vystrcil
5,836,047 A 11/1998 Lee
5,842,254 A 12/1998 Lee
6,058,559 A 5/2000 Yoshimi
6,094,775 A 8/2000 Behmer
6,108,861 A 8/2000 Vystrcil
6,122,796 A 9/2000 Downham
6,295,692 B1 10/2001 Shideler
6,374,453 B1 4/2002 Kim
6,779,229 B2 8/2004 Lee
6,835,222 B2 12/2004 Gammack
6,839,934 B2 1/2005 Houghton
6,902,596 B2 6/2005 Conrad
6,961,975 B2 10/2005 Park
6,974,488 B2 12/2005 Dyson
7,069,619 B2 7/2006 Bowden
7,152,275 B2 12/2006 Hitzelberger
7,171,724 B2 2/2007 Follegot
7,188,388 B2 3/2007 Best
7,291,190 B2 11/2007 Dummelow et al.
7,337,493 B2 3/2008 Ueyama
7,350,263 B2 4/2008 Yoshimi
7,360,274 B2 4/2008 Park
7,377,007 B2 5/2008 Best
7,377,008 B2 5/2008 Park
7,594,296 B2 9/2009 Park
7,594,297 B2 9/2009 Choi
7,600,291 B2 10/2009 Choi
7,624,475 B2 12/2009 Choi
7,637,991 B2 12/2009 Eddington
7,776,120 B2 8/2010 Conrad
7,803,207 B2 9/2010 Conrad
7,810,210 B2 10/2010 Yoo
7,867,307 B2 1/2011 Bates
7,874,041 B2 1/2011 Buller
7,895,708 B2 3/2011 Proud
7,931,716 B2 4/2011 Francis
7,934,286 B2 5/2011 Yoo
7,937,802 B2 5/2011 Yoo
7,941,895 B2 5/2011 Conrad
7,979,953 B2 7/2011 Yoo
8,032,981 B2 10/2011 Yoo
8,048,183 B2 11/2011 Conrad
8,117,712 B2 2/2012 Dyson
8,127,398 B2 3/2012 Conrad
8,151,407 B2 4/2012 Conrad
8,166,607 B2 5/2012 Conrad
8,236,077 B2 8/2012 Gomiciaga-Pereda
8,250,702 B2 8/2012 Conrad
8,296,900 B2 10/2012 Conrad
8,302,250 B2 11/2012 Dyson
8,343,654 B2 1/2013 Churchill
8,347,455 B2 1/2013 Dyson
8,375,508 B2 2/2013 Conrad
8,387,204 B2 3/2013 Dyson
8,397,344 B2 3/2013 Liddell
8,444,731 B2 5/2013 Gomiciaga-Pereda
8,468,646 B2 6/2013 Yoo
8,479,358 B2 7/2013 Conrad
8,510,907 B2 8/2013 Conrad
8,567,006 B2 10/2013 Conrad
8,667,640 B2 3/2014 Conrad
8,671,510 B2 3/2014 Han
8,673,487 B2 3/2014 Churchill
8,713,754 B2 5/2014 Conrad
8,769,764 B2 7/2014 Crouch
8,776,309 B2 7/2014 Conrad
8,813,305 B2 8/2014 Conrad
8,869,348 B2 10/2014 Conrad
8,875,340 B2 11/2014 Conrad
8,875,342 B2 11/2014 Conrad
8,943,647 B1 2/2015 Henderson
8,950,039 B2 2/2015 Conrad
8,997,309 B2 4/2015 Conrad
9,015,899 B2 4/2015 Conrad
9,027,198 B2 5/2015 Conrad
9,066,642 B2 6/2015 Conrad
9,066,643 B2 6/2015 Conrad
9,078,549 B2 7/2015 Conrad
9,084,522 B2 7/2015 Conrad
9,084,523 B2 7/2015 Conrad
9,084,524 B2 7/2015 Conrad
9,095,245 B2 8/2015 Conrad
9,119,514 B2 9/2015 Conrad
9,138,114 B2 9/2015 Conrad
9,155,431 B2 10/2015 Dyson
2005/0160554 A1 7/2005 Ueyama
2006/0213024 A1 9/2006 Lee
2006/0218741 A1 10/2006 Kang
2007/0157425 A1 7/2007 Battle
2007/0289085 A1 12/2007 Yoo
2009/0031522 A1 2/2009 Yoo
2009/0144929 A1 6/2009 Yoo
2009/0313958 A1 12/2009 Gomiciaga-Pereda et al.
2010/0175217 A1 7/2010 Conrad
2010/0229338 A1 9/2010 Conrad
2011/0219567 A1 9/2011 Conrad
2011/0219571 A1 9/2011 Dyson
2011/0219579 A1 9/2011 Conrad
2011/0314629 A1 12/2011 Conrad
2011/0314631 A1 12/2011 Conrad
2012/0000033 A1 1/2012 Conrad
2012/0030896 A1* 2/2012 Crouch ..... A47L 5/225 15/339
2012/0030897 A1 2/2012 Crouch
2012/0079671 A1 4/2012 Stickney
2012/0222252 A1 9/2012 Conrad
2012/0272472 A1 11/2012 Conrad
2013/0160232 A1 6/2013 Peace
2013/0174372 A1 7/2013 Guder
2013/0205538 A1 8/2013 Thompson
2013/0207615 A1 8/2013 Sunderland
2014/0041149 A1 2/2014 Henderson
2014/0053367 A1 2/2014 Conrad
2014/0082881 A1 3/2014 Conrad
2014/0096341 A1 4/2014 Conrad
2014/0137364 A1 5/2014 Stickney
2014/0237752 A1 8/2014 Conrad
2014/0237753 A1 8/2014 Conrad
2014/0237754 A1 8/2014 Conrad
2014/0237755 A1* 8/2014 Conrad ..... A47L 5/225 15/329
2014/0237756 A1 8/2014 Conrad
2014/0237757 A1 8/2014 Conrad
2014/0237758 A1 8/2014 Conrad
2014/0237759 A1 8/2014 Conrad
2014/0237762 A1 8/2014 Conrad
2014/0237764 A1 8/2014 Conrad
2014/0237766 A1 8/2014 Conrad
2014/0237767 A1 8/2014 Conrad
2014/0237768 A1 8/2014 Conrad
2014/0237955 A1 8/2014 Conrad
2014/0237956 A1 8/2014 Conrad
2014/0237964 A1 8/2014 Conrad
2014/0237965 A1 8/2014 Conrad
2014/0245562 A1 9/2014 Conrad
2014/0245564 A1 9/2014 Conrad
2014/0245566 A1 9/2014 Conrad

(56) References Cited

U.S. PATENT DOCUMENTS

| | | | |
|---|---|---|---|
| 2014/0259513 | A1 | 9/2014 | Conrad |
| 2014/0259518 | A1 | 9/2014 | Conrad |
| 2014/0259519 | A1 | 9/2014 | Conrad |
| 2014/0283332 | A1 | 9/2014 | Conrad |
| 2014/0289996 | A1 | 10/2014 | Conrad |
| 2014/0298611 | A1 | 10/2014 | Conrad |
| 2014/0366309 | A1 | 12/2014 | Conrad |
| 2014/0366310 | A1 | 12/2014 | Conrad |
| 2014/0366314 | A1 | 12/2014 | Conrad |
| 2015/0000069 | A1 | 1/2015 | Conrad |
| 2015/0007409 | A1 | 1/2015 | Conrad |
| 2015/0026916 | A1 | 1/2015 | Conrad |
| 2015/0074937 | A1 | 3/2015 | Conrad |
| 2015/0096143 | A1 | 4/2015 | Conrad |
| 2015/0096144 | A1 | 4/2015 | Conrad |
| 2015/0135474 | A1 | 5/2015 | Gidwell |
| 2015/0201817 | A1 | 7/2015 | Khalil |
| 2015/0223650 | A1 | 8/2015 | Krebs |
| 2015/0250366 | A1 | 9/2015 | Conrad |

FOREIGN PATENT DOCUMENTS

| | | | |
|---|---|---|---|
| DE | 10162455 | | 7/2003 |
| EP | 0853917 | | 7/1998 |
| EP | 0900045 | | 3/1999 |
| EP | 1136029 | | 9/2001 |
| EP | 2484259 | A2 | 8/2012 |
| FR | 2298305 | | 8/1976 |
| GB | 2441962 | | 3/2008 |
| GB | 2478599 | | 9/2011 |
| GB | 2484146 | A | 4/2012 |
| JP | 60220027 | | 2/1985 |
| JP | 61131720 | | 6/1986 |
| JP | 6415020 | | 1/1989 |
| JP | 2005040246 | | 2/2005 |
| JP | 2005095275 | | 4/2005 |
| WO | 8607247 | | 12/1986 |
| WO | 9911170 | | 3/1999 |
| WO | 2008009883 | | 1/2008 |

OTHER PUBLICATIONS

International Preliminary Report on Patentability and Written Opinion for International Application No. PCT/IB2016/001989, dated Jun. 26, 2018, 8 pages.

* cited by examiner

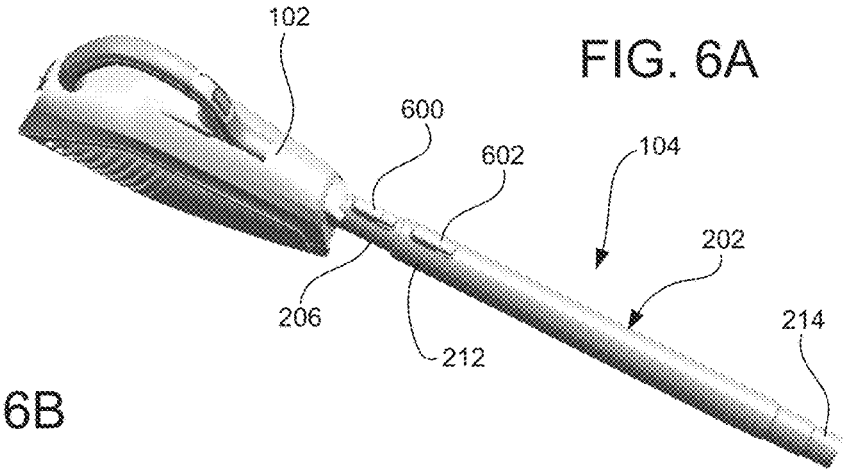
FIG. 6A
FIG. 6B
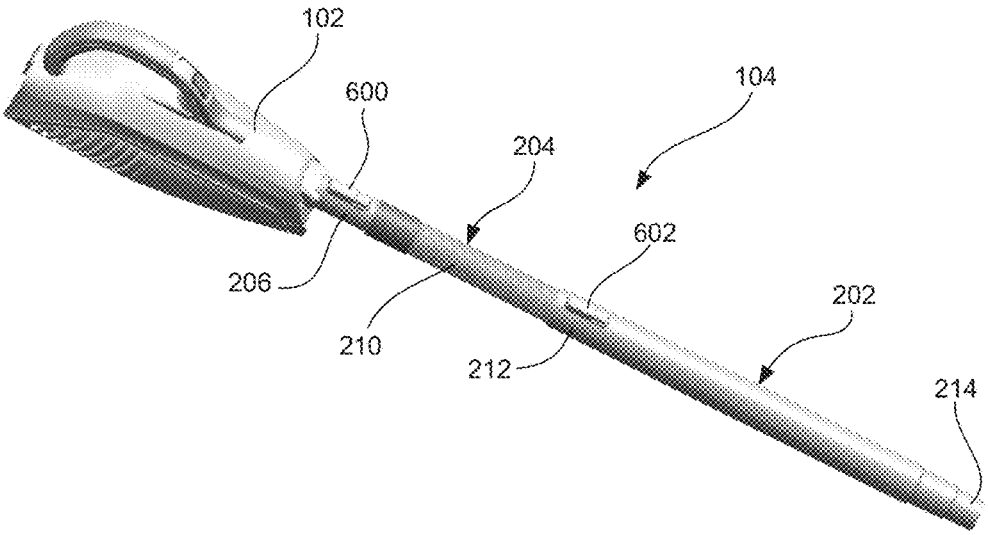
FIG. 6C
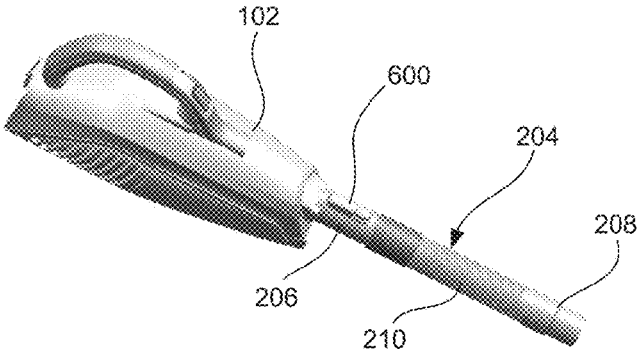

VERSATILE VACUUM CLEANERS

BACKGROUND OF THE INVENTION

Field of the Invention

The present invention relates to vacuum cleaners.

Description of the Related Art

Vacuum cleaners are common household items that are used for a variety of cleaning tasks. Vacuum cleaners are provided in various configurations, which often times are tailored to particular cleaning requirements or methods. For example, upright vacuum cleaners typically join a suction fan, dirt receptacle, and floor cleaning base into a single integrated structure, which is convenient and simple to use, but often is quite heavy. Lighter-weight versions of upright vacuums, typically called "stick" vacuum cleaners, are also known. Other vacuum cleaners are configured as a canister containing the vacuum fan and dirt receptacle, which fluidly connected to a cleaning wand by a flexible hose. Other configurations are known in the art.

While current vacuum cleaners provide various levels of utility, convenience, and flexibility, there still remains a need to advance the state of the art by providing alternative or improved vacuum cleaners.

SUMMARY

In one exemplary aspect, there is provided a vacuum cleaner having a vacuum unit and a wand assembly. The vacuum unit has a housing, a power supply, a suction generator located in the housing, a dirt collector operatively associated with the housing, and a vacuum unit inlet in fluid communication with the dirt collector and the suction generator. The wand assembly is attached to and in fluid communication with the vacuum unit inlet. The wand assembly has a rigid portion having a proximal wand end and a distal wand end spaced along a longitudinal axis from the proximal wand end, and the rigid portion is reconfigurable between a first wand condition in which the proximal wand end is rigidly connected to the vacuum unit inlet and the distal wand end is in fluid communication with the vacuum unit inlet, and a second wand condition in which the proximal wand end is movable relative to the vacuum unit inlet and the distal wand end is in fluid communication with the vacuum unit inlet. The flexible portion has a proximal hose end configured to rigidly connect to the vacuum unit inlet with the proximal hose end in fluid communication with the vacuum unit inlet, a distal hose end configured to fit inside the rigid portion and be in fluid communication with the distal wand end, and a flexible hose fluidly connecting the distal hose end to the proximal hose end. The flexible hose is telescopically movable relative to the rigid portion between a first hose condition corresponding to the first wand condition in which the flexible hose is located entirely inside the rigid portion, and a second hose condition corresponding to the second wand condition in which at least a portion of the flexible hose adjacent the proximal hose end extends outside the rigid portion.

In various aspects, the vacuum unit may have a first electrical connector operatively associated with the power supply, and the proximal hose end may have a second electrical connector, and the second electrical connector may be electrically connected to the first electrical connector when the proximal hose end is rigidly connected to the vacuum unit inlet. In this aspect, the rigid portion may have a third electrical connector that is electrically connected to the second electrical connector when the rigid portion is in the first wand condition. However, the third electrical connector also may not be electrically connected to the second electrical connector when the rigid portion is in the second wand condition. The first electrical connector may be operatively associated with the power supply through a user-operable switch.

In other aspects, the proximal hose end may be selectively removable from the vacuum unit inlet. In this aspect, the vacuum cleaner may have an accessory having an accessory connector and an accessory inlet in fluid communication with the accessory connector, and the vacuum cleaner may be reconfigurable between a first accessory condition in which the distal wand end is connected to the accessory connector with the accessory inlet in fluid communication with the vacuum unit inlet, and a second accessory condition in which the proximal hose end is removed from the vacuum unit inlet and the vacuum unit inlet is connected to the accessory connector without the wand assembly and with the accessory inlet in fluid communication with the vacuum unit inlet. The vacuum cleaner also may be further reconfigurable to a third accessory condition in which the rigid portion is removed from the flexible portion and the accessory connector is connected to the distal hose end without the rigid portion and with the accessory inlet in fluid communication with the vacuum unit inlet. The vacuum unit also may have a first electrical connector operatively associated with the power supply, the rigid portion may have a second electrical connector, and the accessory connector may have a third electrical connector, and the second electrical connector may be electrically connected to the first electrical connector when the proximal wand end is in the first wand condition, the third electrical connector may be electrically connected to the second electrical connector when the accessory is in the first accessory condition, and the third electrical connector may be electrically connected to the first electrical connector when the accessory is in the second accessory condition. The vacuum unit also may have a first electrical connector operatively associated with the power supply, the proximal hose end further may have a second electrical connector, the rigid portion may have a third electrical connector, and the accessory connector may have a fourth electrical connector, and the second electrical connector may be electrically connected to the first electrical connector when the proximal hose end is rigidly connected to the vacuum unit inlet, the third electrical connector may be electrically connected to the second electrical connector when the proximal wand end is in the first wand condition, the fourth electrical connector may be electrically connected to the third electrical connector when the accessory is in the first accessory condition, and the fourth electrical connector may be electrically connected to the first electrical connector when the accessory is in the second accessory condition. Also, the second electrical connector may not extend from the proximal hose end to the distal hose end, or the second electrical connector may extend from the proximal hose end to the distal hose end and the vacuum cleaner may be further reconfigurable to a third accessory condition in which the rigid portion is removed from the flexible portion and the accessory connector is connected to the distal hose end without the rigid portion and with the accessory inlet in fluid communication with the vacuum unit inlet and the fourth electrical connector electrically connected to the second electrical connector.

In other aspects, the proximal wand end may be rigidly connected to the vacuum unit by way of the proximal hose end when the rigid portion is in the first wand condition. These aspects also may have a first clasp configured to selectively hold the proximal hose end to the vacuum unit inlet, and a second clasp configured to selectively hold the proximal wand end to the proximal hose end.

In further aspects, the proximal wand end may be rigidly connected directly to the vacuum unit when the rigid portion is in the first wand condition. These aspects may have a first clasp configured to selectively hold the proximal hose end to the vacuum unit inlet, and a second clasp configured to selectively hold the proximal wand end to the vacuum unit inlet.

In other aspects, the distal hose end may be slidable within the rigid portion between a first position in which the distal hose end is adjacent the distal wand end and a second position in which the distal hose end is adjacent the proximate wand end. In these aspects, there may be a clasp configured to selectively prevent the distal hose end from passing through the proximate wand end.

In other aspects, the wand assembly may be selectively removable from the vacuum unit.

In other aspects, the power supply may include at least one of a power cord and a battery.

Other alternatives will be apparent to persons of ordinary skill in the art in view of the present disclosure.

The recitation of this summary of the invention is not intended to limit the claims of this or any related or unrelated application. Other aspects, embodiments, modifications to and features of the claimed invention will be apparent to persons of ordinary skill in view of the disclosures herein.

BRIEF DESCRIPTION OF THE DRAWINGS

A better understanding of the exemplary embodiments may be understood by reference to the attached drawings, in which like reference numbers designate like parts. The drawings are exemplary and not intended to limit the claims in any way.

FIGS. 6A-6C show the vacuum cleaner of FIG. 1 in additional configurations.

DETAILED DESCRIPTION

Figure 1:
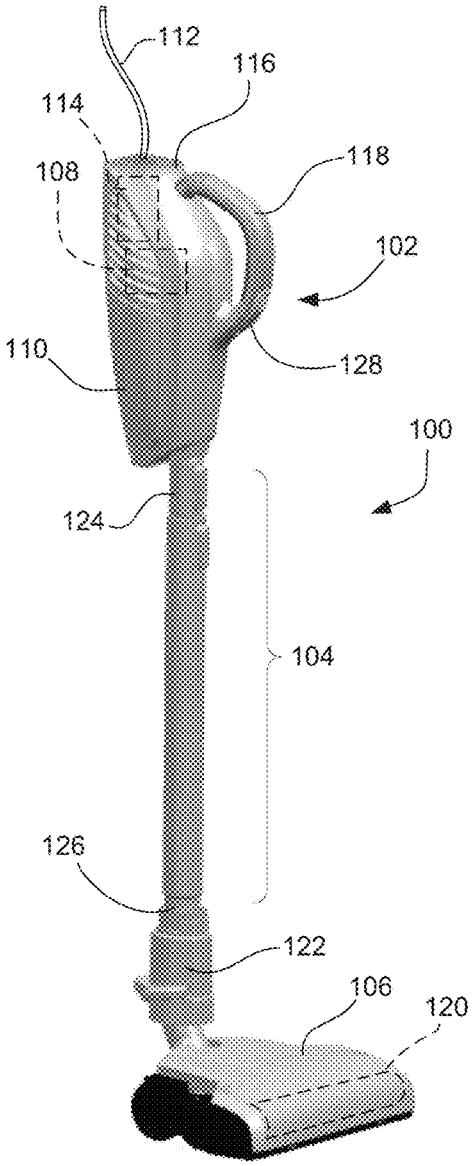
FIG. 1 is a vacuum cleaner shown in first configuration.

FIG. 1 illustrates a first exemplary embodiment of a vacuum cleaner 100. The vacuum cleaner 100 includes a vacuum unit 102, a wand assembly 104, and a base 106 having a base inlet (i.e., a suction opening) that can be positioned to face a floor or other surface to be cleaned.

The vacuum unit 102 contains a suction generator 108 that is operatively connected to a dirt collector 110. The suction generator 108 may comprise an impeller connected to an electric motor, as well-known in the art, which may be powered by household mains via a cord 112, by batteries 114, by a combination of a cord 112 and batteries 114 (used alternatively or simultaneously), or by other power sources. Examples of vacuum units are provided in U.S. Pat. Nos. 8,302,251 and 8,595,897, which are incorporated herein by reference. The suction generator 108 is operatively connected to the dirt collector 110. This may be done by positioning a suction inlet of the suction generator 108 in fluid communication with a fluid outlet of the dirt collector 110 to operate the dirt collector 110 under negative pressure, or by positioning the suction generator 108 upstream of the dirt collector 110 to operate the dirt collector 110 under positive pressure.

The dirt collector 110 may comprise any suitable device, such as a bag chamber that contains a filter bag that removes dirt from the air, a dirt cup that contains a screen or filter to remove the dirt from the air, a cyclone that uses one or more cyclonic cleaning stages (and optionally perforated screens or filters) to centrifuge dirt from the air, and combinations of the foregoing and other devices. The dirt collector 110 preferably includes a collecting cup portion that receives the bulk of the separated dirt. The dirt collector 110 may be configured for emptying using any conventional construction. For example the dirt collector 110 may be removable in its entirety from the vacuum unit 102, or only the collecting cup portion may be removable. The dirt collector 110 also may include an openable door to allow emptying without removal from the vacuum unit 102. Other alternatives will be apparent to persons of ordinary skill in the art in view of the present disclosure.

The suction generator 108 and dirt collector 110 are provided in or on a rigid housing 116. The housing 116 may include a hand grip 118 that is shaped and sized to be held by a typical operator's hand. The housing 116 also may include vents and other structures such as tool storage mounts, and the like, as known in the art.

Figure 2:
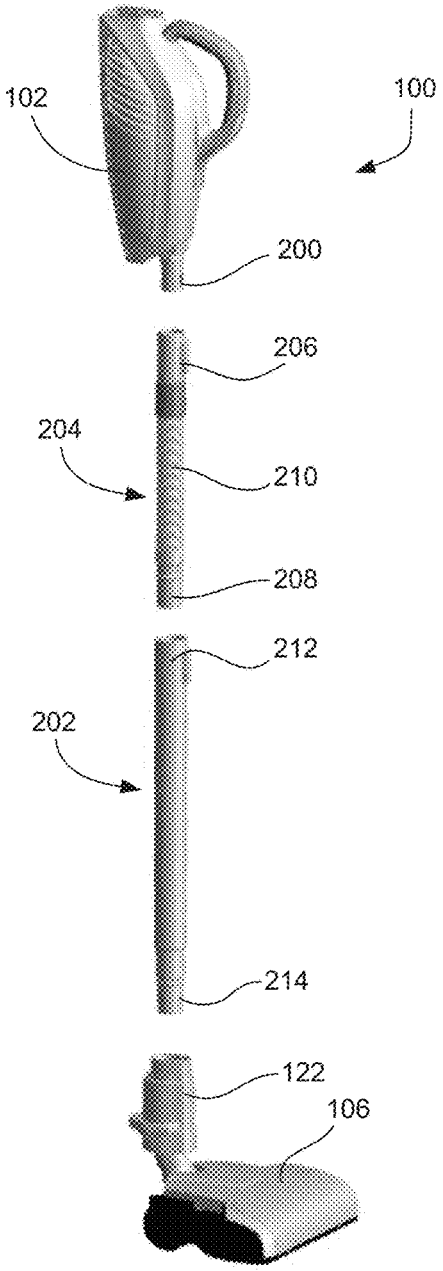
FIG. 2 is the vacuum cleaner of FIG. 1 shown in a second configuration.

The vacuum unit 102 also includes a vacuum unit inlet 200 (FIG. 2). The vacuum unit inlet 200 is an opening that is in fluid communication with the suction generator 108 and dirt collector 110 via suitable passages internal to the housing 116. The vacuum unit inlet 200 may be provided at any suitable part of the vacuum unit 102. For example, the vacuum unit inlet 200 may be part of or attached to the housing 116 and located remotely from the dirt collector 110, or it may comprise a structure that is attached directly to the dirt collector 110. The vacuum unit inlet 200 also may comprise a mounting structure for attaching to the wand assembly 104, as described in more detail below. The mounting structure may be a "male" fitting that is generally external to the housing 116, or it may be a "female" fitting that is generally internal to the housing 116. The vacuum unit inlet 200 also may include one or more electrical connectors that are wired to the power source, preferably via one or more user-controllable switches 128 or other circuitry, to selectively activate the suction generator 108, provide power to the wand assembly 104 and attached accessories via electrical connectors 702 (see FIG. 7), and so on.

The particular details of the vacuum unit 102 can vary according to desired specifications, and it will be appreciated that features such as pre- and post-suction generator filters, battery compartments and connectors, charger mounting arrangements, and the like may be added to the vacuum unit 102, as desired. The parts of the vacuum unit 102 also may be rearranged in various orientations, as well known in the art. For example, the dirt collector 110 or suction generator 108 may be placed on the front side of the wand assembly axis, instead of the rear side as shown, or the dirt collector 110 may be located above the suction generator 108 instead of below it. These and other suitable configurations of vacuum units, suction generators and dirt collectors are well-known in the art, and need not be described in detail herein.

In the configuration shown in FIG. 1, the parts of the vacuum cleaner 100 are arranged in an upright or "stick" configuration. In this configuration, the vacuum unit 102, wand assembly 104, and base are rigidly connected together to form an integrated cleaning device, and in which the wand assembly 104 and base 106 can be collectively manipulated by a user grasping only the vacuum unit 102. In this configuration, an interior passage within the wand assembly 104 is placed in fluid communication with the vacuum unit inlet 200, and an interior passage within the base 106 fluidly connects the floor-facing inlet on the bottom of the base to the interior passage within the wand assembly 104. Electrical leads may place the wand assembly 104 into electrical communication with the vacuum unit 102, and the base 106 into electrical communication with the wand assembly 104, such as explained in more detail below, to power one or more motors (e.g., brushroll motors) within the base 106.

Figure 3:
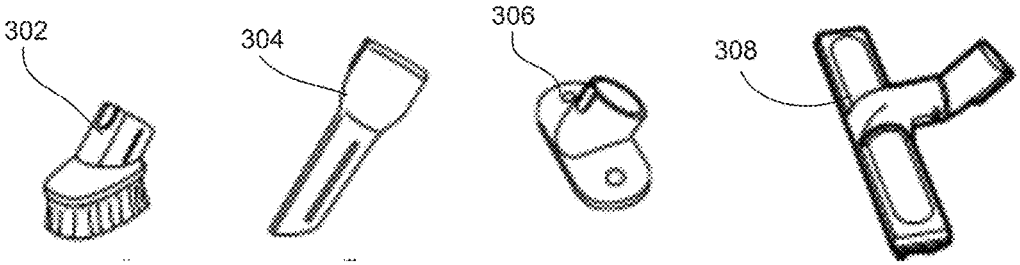
FIG. 3 illustrates exemplary vacuum cleaning accessories.

As shown in FIG. 2, the wand assembly 104 may be removed from the vacuum unit 102, to allow the vacuum unit 102 to be used separately as a handheld cleaner. In this configuration, a user may operate the vacuum unit 102 by passing dirt and debris directly into the vacuum unit inlet 200, or by attaching one or more accessories to the vacuum unit inlet 200 to extend the reach or change the cleaning properties of the device. Exemplary accessories that may be attached to the vacuum unit inlet 200 are shown in FIG. 3. These include a suction brush 302, a crevice tool 304, an upholstery brush 306, a bare floor sweeping tool 308, and so on. Each accessory includes a suction inlet 310 that is fluidly connected to an accessory connector 312 configured to engage the vacuum unit inlet 200 or other suction connection. Accessory tools may include brushes and other devices that may be electrically powered by batteries or by connection to electrical leads provided on the vacuum unit 102. Such tools also may include brushes or other devices that are powered by airflow through the tool (e.g., so-called "turbo" tools). Other accessory tools may include hoses, wands, and the like. Other alternatives will be apparent to persons of ordinary skill in the art in view of the present disclosure.

Figure 4:
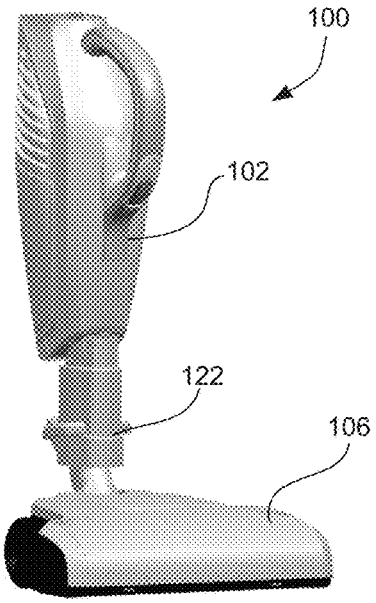
FIG. 4 is the vacuum cleaner of FIG. 1 shown in a third configuration.

The base 106 may include a surface agitator 120, such as a rotating brush or the like, that is powered by electrical leads that pass through the wand assembly 104. The base 106 preferably is configured to selectively attach directly to the wand assembly 104, such as shown in FIG. 1, and the vacuum unit 102, such as shown in FIG. 4, to provide a version of a "handheld" arrangement. To this end, the base 106 may include a base connector 122 that can engage and provide fluid and electrical connections to both the vacuum unit inlet 200 and the distal end of the wand assembly 104. (As used herein, "distal" refers to locations relatively far from the vacuum unit 102, and "proximal" refers to locations relatively close to the vacuum unit 102.) The base connector 122 may comprise a pivoting joint to allow the wand assembly 104 and vacuum unit 102 to be leaned back during use. The base connector 122 also may provide multiple degrees of freedom between the wand assembly 104 and the base 106. For example, the base connector 122 may comprise a universal joint or a swiveling joint, or the like. The base connector 122 also may be configured to hold the wand assembly 104 and vacuum unit 102 in an upright position. This may be accomplished simply by using gravity by selecting the size of the base 106 and orientation of the wand assembly 104 and vacuum unit 102 so that the center of gravity lies within the profile of the base supports (e.g., wheels, skids, and the like). The base connector 122 also may include a lock to hold the parts in the upright position, and may be configured to turn the wand assembly to face a particular direction when the parts are moved to the upright position. Examples of connector joints that are suitable for embodiments are provided in U.S. Pat. Nos. 5,584,095; 6,055,703; 6,519,810; 6,823,559; 7,503,098; 7,356,876; 8,302,251; 8,595,897 and 8,869,348, which are all incorporated herein by reference.

The base 106 also may be removable from the wand assembly 104, while the wand assembly 104 remains attached to the vacuum unit 102. In this configuration, the vacuum cleaner 100 may be operated by directing the open end of the wand assembly 104 to pick up dirt and debris, or one or more different accessories may be attached to the end of the wand assembly 104. These accessories may be powered by electrical leads such as those that power a motor for the agitator 120, or they may be unpowered. For example, the base 106 may be replaced by a bare floor cleaning tool 500 shown in FIG. 5, which does not include a powered brush, or by the collection of accessories shown in FIG. 3. Other accessories may be attached in other embodiments.

The wand assembly 104 extends from a proximal wand assembly end 124 that connects to the vacuum unit 102, to a distal wand assembly end 126 that connects to the base 106. As shown in FIG. 2, the wand assembly 104 preferably includes a rigid portion 202 and a flexible portion 204 that form an internal airflow passage from the base 106 to the vacuum unit 102. The rigid portion 202 and flexible portion 204 preferably are reconfigurable into multiple positions relative to one another. For example, the rigid portion 202 and flexible portion 204 may be nested together, such as shown in FIG. 1, or completely separated from one another, such as shown in FIG. 2.

In this embodiment, the flexible portion 204 includes a rigid proximal hose end 206 that selectively attaches directly to the vacuum unit inlet 200, a rigid distal hose end 208 that slides into the rigid portion 202, and a flexible hose 210 extending between the ends 206, 208. The rigid portion 202 is provided as a hollow wand structure that has a proximal wand end 212 that extends along a longitudinal axis to a distal wand end 214. The proximal wand end 212 slides over the full length of the flexible hose 210 to connect to the rigid proximal hose end 206, and the distal wand end 214 selectively connects to the base connector 122. In this example, the rigid proximal hose end 206 is positioned structurally between the rigid portion 202 and the vacuum unit 102.

FIGS. 6A-6C show various configurations that the exemplary wand assembly 104 may attain. In FIG. 6A, the wand assembly 104 is fully contracted, with the flexible portion 204 contained completely within the rigid portion 202 and the proximal wand end 212 rigidly connected to the proximal hose end 206. In this position, the proximal wand end 212 cannot move relative to the proximal hose end 206 by any appreciable amount, and the proximal hose end 206 cannot move relative to the vacuum unit inlet 200 by any appreciable amount, providing a rigid connection between the proximal wand end 212 and the vacuum unit inlet 200.

Figure 5:
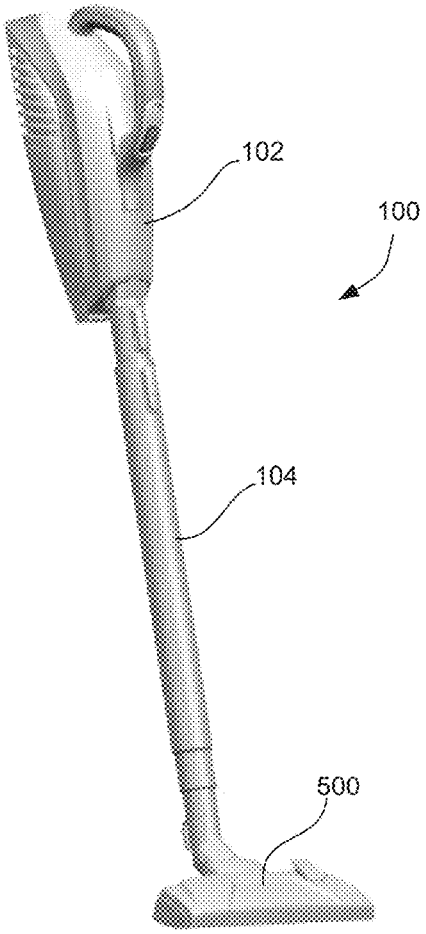
FIG. 5 is the vacuum cleaner of FIG. 1 shown in a fourth configuration.

Like the embodiments of FIGS. 1 and 5, this provides an "upright" or "stick" arrangement.

A first clasp 600 is provided on the proximal hose end 206 to releasably hold the proximal hose end 206 to the vacuum unit 102. A second clasp 602 is provided on the proximal wand end 212 to releasably hold the proximal wand end 212 to the proximal hose end 206 with the rigid portion 202 fully covering the flexible hose 210. This configuration provides a rigid pathway from the vacuum unit 102 to the distal wand end 214. An operator may grasp the vacuum unit 102 and/or the rigid portion 202 to manipulate the vacuum cleaner 100 as a single rigid unit to pick up debris. A base 106 or other accessory may be attached to the distal wand end 214, or it may be operated without an accessory. The first clasp 600 may be disengaged to completely remove the wand assembly 104 and operate the vacuum unit 102 alone in a "hand-held" configuration, as discussed above.

The second clasp 602 may be disengaged, while the first clasp 600 remains engaged, to slide the rigid portion 202 telescopically over the flexible portion 204 to expose some or all of the flexible hose 210, such as shown in FIG. 6B. In this configuration, the flexible portion 204 provides a flexible fluid connection between the proximal wand end 212 and the vacuum unit 102, which allows the proximal wand end 212 and the rest of the rigid portion 202 to move relative to the vacuum unit inlet. This provides a "canister" arrangement, which may give the user a greater measure of operational flexibility. For example, an operator may grasp the vacuum unit 102 in one hand and the rigid portion 202 in the other hand, and operate the rigid portion 202 somewhat independently of the vacuum unit 102. Alternatively, the user may put the vacuum unit 102 down or mount the vacuum unit 102 to a wall or other surface, and simply hold the rigid portion 202 during use. The vacuum unit 102 also may include a shoulder strap, belt, belt loop, or the like, to allow the user to mount the vacuum unit 102 on the user's body without having to hold it in a hand. Other alternatives will be apparent to persons of ordinary skill in the art in view of the present disclosure.

The rigid portion 202 and flexible portion 204 also may be configured to completely remove the rigid portion 202, such as shown in FIG. 6C. Here, the distal hose end 208 has been separated from the rigid portion 202. In this configuration, the operator may hold and manipulate the flexible portion 204, such as by holding a rigid cuff that forms the distal hose end 208. The user also preferably can connect one or more accessories to the distal hose end 208. For example, the accessories shown in FIGS. 3 and 5 may be mounted to the distal hose end 208. If the hose is provided with electrical power, accessories like the powered base 106 shown in FIG. 1 also may be attached and powered through the hose. Other alternatives will be apparent to persons of ordinary skill in the art in view of the present disclosure.

Any suitable connector arrangement or arrangements may be used to releasably interconnect the vacuum unit 102, rigid portion 202, flexible portion 204, base 106 and accessories. For example, the vacuum unit inlet 200, proximal hose end 206, proximal wand end 212, distal wand end 214, and base connector 122 may comprise simple tapered slip connectors that engage one another by friction. In a more preferred embodiment, the connectors may include releasable catches or the like, to reduce the likelihood of inadvertent release. Examples of connectors that may be used include those shown in U.S. Pat. Nos. 2,660,457; 2,867,833; 4,955,106; 6,108,861; and 7,895,708, which are all incorporated herein by reference.

Figure 7A:
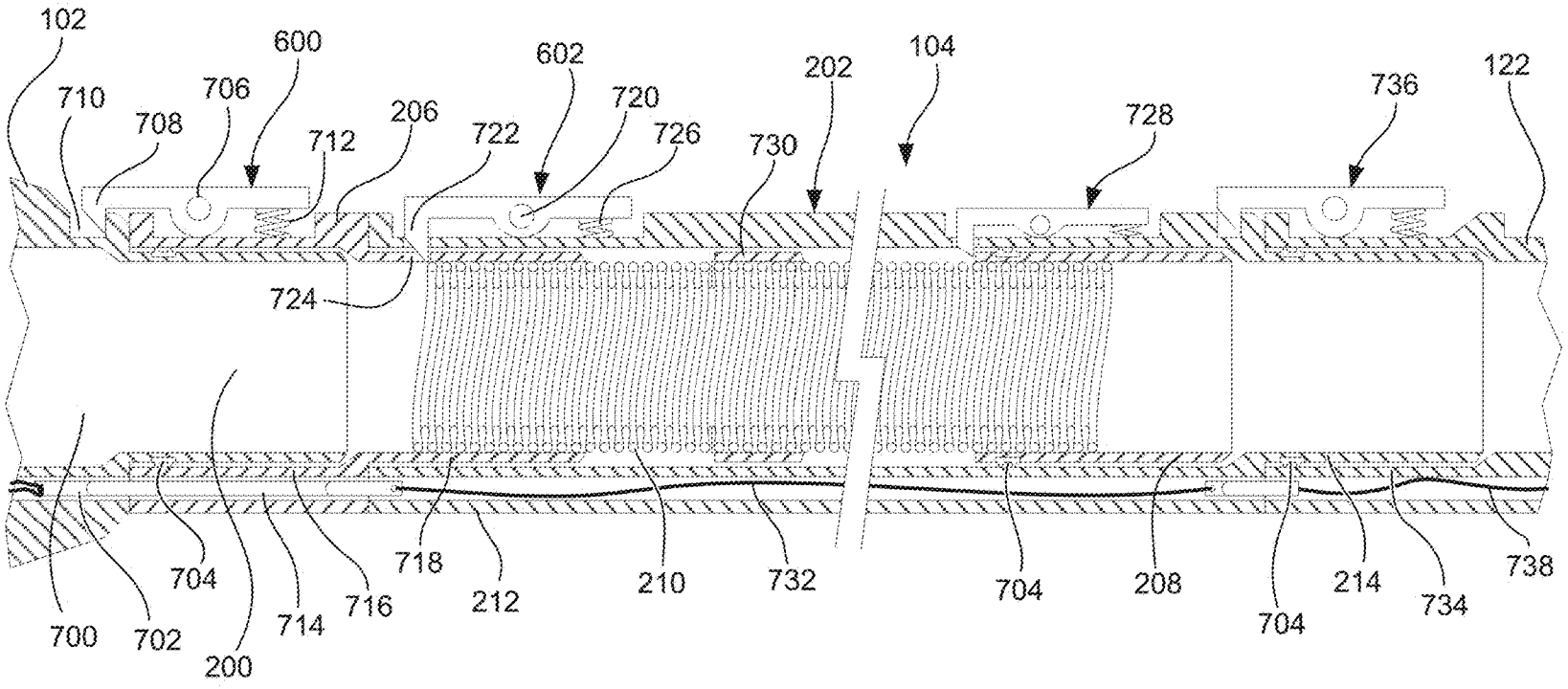
FIGS. 7A-7C show an embodiment of a wand assembly and associated parts of a vacuum cleaner, in three different configurations.
Figure 7B:
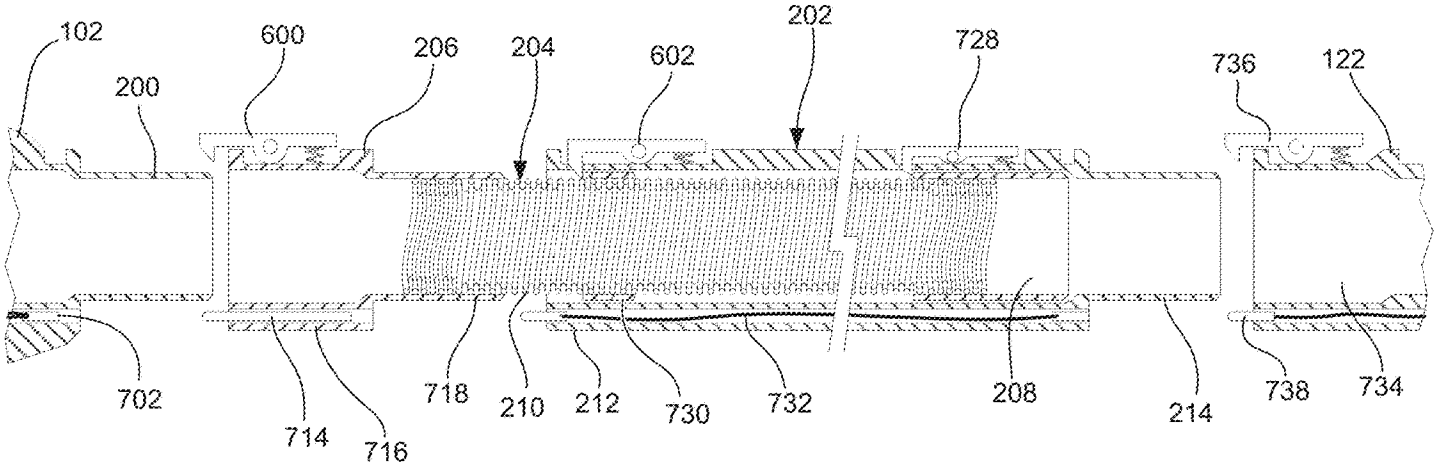
Figure 7C:
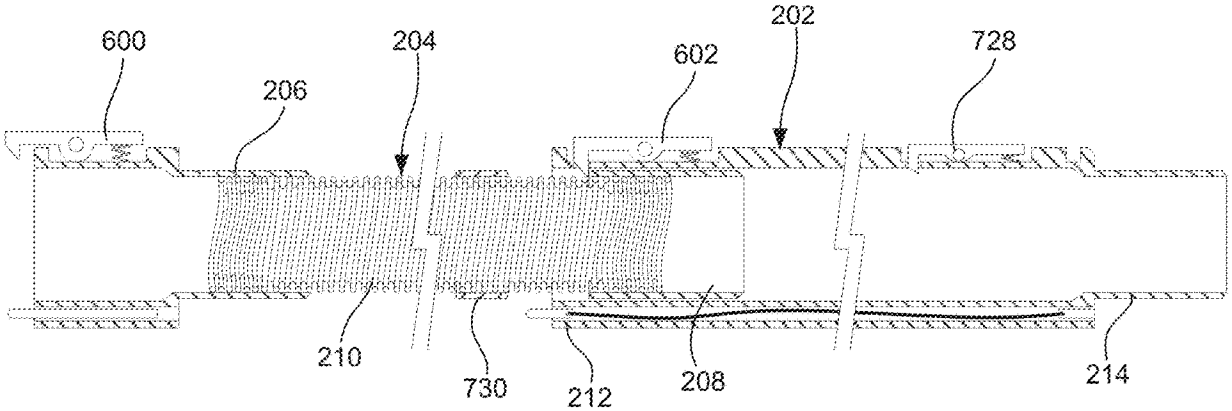

FIGS. 7A-7C show an embodiment of an exemplary connection system to join a vacuum unit 102 to a wand assembly 104 and base 106. In this example, the vacuum unit inlet 200 comprises a male adapter that protrudes from the vacuum unit 102 and has an air passage 700 and a first electrical connector 702 located outside the air passage 700. The proximal hose end 206 comprises a hollow, rigid collar having a first portion 716 that is shaped and sized to slide over the vacuum unit inlet 200. One or more air seals 704 may be provided on the outer surface of the vacuum unit inlet 200 or the inner surface of the proximal hose end 206 to help mitigate air leaks at the connection.

A first clasp 600 selectively holds the proximal hose end 206 on the vacuum unit inlet 200. In this case, the first clasp 600 comprises a rocker latch that is mounted to the proximal hose end 206 on a pivot 706. The first clasp 600 has, at one end, a hook 708 that fits into a corresponding receptacle 710 on the vacuum unit inlet 200. A spring 712 is provided at the other end of the first clasp 600 to bias the first clasp 600 to rotate about the pivot 706 to hold the hook 708 in the receptacle 710. The first clasp 600 is disengaged by pressing down over the spring 712 to rotate the hook 708 out of the receptacle 710, after which the wand assembly 104 may be removed from the vacuum unit 102. Also, the hook 708 preferably has a tapered face that automatically moves the first clasp 600 to the disengaged position as the proximal hose end 206 is slid towards the vacuum unit 102, so that it is not necessary to manually disengage the first clasp 600 when installing the proximal hose end 206 to the vacuum unit inlet 200.

The proximal hose end 206 also includes a second electrical connector 714. The second electrical connector 714 is provided in one or more insulated passages extending through the first portion 716 of the proximal hose end 206, and is positioned to contact the first electrical connector 702 when the proximal hose end 206 is engaged with the vacuum unit inlet 200. It will be appreciated that the second electrical connector 714 may comprise one or more electrical conduction paths, and the term "electrical connector" is used herein to describe any single or collection of electrical paths (e.g., a single "electrical connector" may have paths for positive and negative power leads, and one or more control signal leads). Any suitable mating electrical connector structures may be used for the first and second electrical connectors 702, 714, and other electrical connectors discussed herein. For example, the first electrical connector 702 may comprise one or more steel pins, and the second electrical connector may comprise one or more corresponding steel sockets that receive the pins. Electrical connectors, conductive materials, wiring, and the like, are known in the art of vacuum cleaners, and suitable embodiments will be readily apparent to persons of ordinary skill in the art in view of this disclosure, and need not be described in detail herein.

The proximal hose end 206 also includes a second portion 718 that extends distally from the first portion 716. The second portion 718 comprises a hollow structure, and it may have smaller inside and outside diameters than the first portion 716. The second portion 718 is configured to engage the proximal wand end 212. In this example, the proximal wand end 212 is shaped and sized to slide over the second portion 718. An seal (not shown) may be provided at this connection. The second portion 718 and the proximal wand end 212 are selectively connected to one another by a second clasp 602. The second clasp 602 may be similar to or different from the first clasp 600. Here, the second clasp 602 is mounted to the proximal wand end 212 on a pivot 720, and includes a hook 722 that engages a receptacle 724 on the second portion 718 of the proximal hose end 206, and a spring 726 to bias the hook 722 into the receptacle 724. The second clasp 602 is structurally and functionally similar to the first clasp 600 and needs no further description herein.

The proximal end of the flexible hose 210 is connected to the second portion 718 of the proximal hose end 206. The flexible hose 210 may comprise any suitable flexible passage, such as a flexible plastic tube having a spiraling metal wire integrated into the tube to bias the tube into a contracted shape. It is preferred for the flexible hose 210 to be a self-collapsing hose that naturally attains the collapsed position (e.g., under bias of an internal wire) when it is not being actively stretched, but this is not strictly required in all embodiments. The flexible hose 210 may be connected to the proximal hose end 206 using any suitable structure, such as an adhesive, a band clamp, friction fittings, mating threads, or the like. Hose structures and techniques and structures for connecting flexible hoses to rigid end connectors are well known in the art, and need not be described herein.

The distal hose end 208 comprises a hollow, rigid cuff that is shaped and sized to fit within the rigid portion 202. The distal end of the flexible hose 210 is connected to the distal hose end 208 by a connection such as described above. The distal hose end 208 preferably is removable from the rigid portion 202, and slidable within the rigid portion 202, but these features are not required in all embodiments. For example, the distal hose end 208 may simply comprise an interior mounting structure located inside the rigid portion 202 (either at the distal wand end 214 or at some location between the proximal wand end 212 and the distal wand end 214) to which the distal end of the flexible hose 210 is permanently connected. In the embodiment of FIGS. 7A-7C, the distal hose end 208 is slidable along the length of the rigid portion 202, and removable from the rigid portion 202. A seal 704 may be provided between the outer surface of the distal hose end 208 and the inner surface of the rigid portion 202 to mitigate air leaks at this location.

One or more clasps may be provided to control the movement of the distal hose end 208. For example, the second clasp 602 may be configured to intercept the distal hose end 208 when the distal hose end 208 assumes a position adjacent the proximal wand end 212, such as shown in FIG. 7B. In this embodiment, the wand assembly 104 may be operated as a combination of a flexible portion 204 and a rigid portion 202, and the second clasp 602 may be released to remove the distal hose end 208 from the rigid portion 202 when it is desired to use only the flexible portion 204. The flexible hose 210 also may include one or more intermediate stop collars 730 that are configured to contact the second clasp 602 to allow a first portion of the flexible hose 210 to protrude from the rigid portion 202 while a second portion of the flexible hose 210 remains inside the rigid portion 202, as shown in FIG. 7B. The intermediate stop collar 730 can be removed from the rigid portion 202 by activating the second clasp 602, to allow more of the flexible hose 210 to extend out of the rigid portion 202. In other embodiments, the intermediate stop collar 730 may be removed, or the second clasp (or an alternative clasp, such as a band clamp) may be provided to selectively grip the outer surface of the flexible hose 210 to hold the flexible hose 210 anywhere along its length. Other alternatives will be apparent to persons of ordinary skill in the art in view of the present disclosure.

A third clasp 728 also may be provided in some embodiments to selectively hold the distal hose end 208 at a location adjacent the distal wand end 214 or at other locations along the length of the wand. Here, the third clasp 728 is mounted to the distal wand end 214 on a pivot, and includes a hook that engages a receptacle on the distal hose end 208, and a spring to bias the hook into the receptacle. The exemplary third clasp 728 is structurally and functionally similar to the second clasp 602 and needs no further description herein. Of course, other types of third clasp 728 may be used instead of the shown device.

As noted above, the proximal wand end 212 is configured to fit over the second portion 718 of the proximal hose end 206. From here, the rigid portion 202 extends to the distal wand end 214 and forms a hollow interior passage to contain the flexible hose 210 and distal hose end 208. The rigid portion 202 also includes a third electrical connector 732 that is contained in an insulated passage extending from the proximal wand end 212 to the distal wand end 214. The third electrical connector 732 preferably comprises a mating connector at each end of the rigid portion 202, and rigid or wire conductors extending between the connectors, but other electricity conducting structures may be used. The third electrical connector 732 is configured at the proximal wand end 212 to engage with the second electrical connector 714 when the proximal wand end 212 is rigidly connected to the proximal hose end 206, such as shown in FIG. 7A.

The distal wand end 214 is configured to selectively connect to the base connector 122. For example, the distal wand end 214 may be shaped and sized to slide within a corresponding receptacle 734 at the proximal end of the base connector 122. A seal 704 may be provided between the outer surface of the distal wand end 214 and the inner surface of the receptacle to mitigate air leaks at this location. The base connector 122 may include a fourth clasp 736 to hold the wand assembly 104 to the base 106. The exemplary fourth clasp 736 is structurally and functionally similar to the first clasp 600 and needs no further description herein. Of course, other types of fourth clasp 736 may be used instead of the shown device. The base connector 122 also includes a fourth electrical connector 738 contained within one or more insulated passages within the base connector 122. The third electrical connector 732 and fourth electrical connector 738 are configured to engage one another when the distal wand end 214 is connected to the base connector 122. Thus, when the parts are assembled as shown in FIG. 7A, the first electrical connector 702, second electrical connector 714, third electrical connector 732 and fourth electrical connector 738 form an electrical path from the vacuum unit 102 to the base 106.

In this example, the distal wand end 214 is shaped as a hollow collar that is similar in shape and size to the male connector provided as the vacuum unit inlet 200, and the receptacle 734 on the base connector 122 is similar in shape and size to the first portion 716 of the proximal hose end 206. Thus, the vacuum unit inlet 200 may be removed from the proximal hose end 206 and connected directly to the base connector 122. Thus configured, the base connector 122 forms a fluid connection with the vacuum unit inlet air passage 700, and the first electrical connector 702 also may connect to and form an electrical path with the fourth electrical connector 738. However, this similarly of structure and interchangeability is not required in all embodiments.

The embodiment of FIGS. 7A-7C may be configured in several different ways. For example, the vacuum unit 102 may be rigidly connected to the base 106 to operate as an upright vacuum by connecting the proximal hose end 206 to the vacuum unit inlet 200, the proximal wand end 212 to the proximal hose end 206, and the distal wand end 214 to the base connector 122, such as shown in FIGS. 1 and 7A. The vacuum unit 102 also may be disconnected from the wand assembly for separate use, as shown in FIGS. 2, 4, 7B and 7C. FIGS. 7B and 7C also show the proximal wand end 212 being disconnected from the proximal hose end 206 to allow the user to expand the wand assembly 104 to have a flexible portion 204 and a rigid portion 202 that are fluidly connected to one another. In these configurations, the proximal hose end 206 may be connected to the vacuum unit inlet 200 to operate the system as a canister-like vacuum cleaner. In addition, the flexible portion 204 may be completely removed from the rigid portion 202, such as by disengaging the second clasp 602 to allow the distal hose end 208 to pass through the proximal wand end 212, while the proximal hose end 206 remains connected to the vacuum unit inlet 200, to allow the user to use the flexible portion 204 without the rigid portion 202. Other alternatives will be apparent to persons of ordinary skill in the art in view of the present disclosure.

It will be appreciated that the embodiment of FIGS. 7A-7C is configured to provide electrical power from the vacuum unit 102 to the rigid portion 202 of the wand assembly 104 by way of the proximal hose end 206. This embodiment also may provide power directly from the vacuum unit 102 to an attachment, such as the base 106, that is attached directly to the vacuum unit 102. However, it does not include an electrical connection that extends through the flexible hose 210 to the distal hose end 208. Thus, the device does not deliver power to accessories that may be attached directly to the distal hose end 208, and the device does not deliver power to accessories that may be attached to the distal wand end 214 when the proximal hose end 206 is connected to the vacuum unit inlet 200, but the proximal wand end 212 is not connected to the proximal hose end 206, such as shown in FIG. 6B). While this limits the use of electrical power to such accessories to certain configurations of the device, it is believed that these limitations are not significant for at least some users. Furthermore, the device may still be operated with powered accessories by providing a separate power path or supply to those accessories. For example, the base 106 may include batteries that power the agitator 120 when an electrical connection is not available through the wand assembly 104, and a radio frequency control switch to activate the batteries when desired. Further, in some embodiments, the proximal wand end 212 and the second clasp 602 may be shaped substantially the same as the first portion 716 of the proximal wand end 206 and the first clasp 600, respectively, so that the flexible portion 204 can be removed and the rigid portion 202 can be attached directly to the vacuum unit inlet 200, with the third electrical connector 732 directly engaging the first electrical connector 702. Air-powered tools also will continue to operate without electrical power.

Figure 8A:
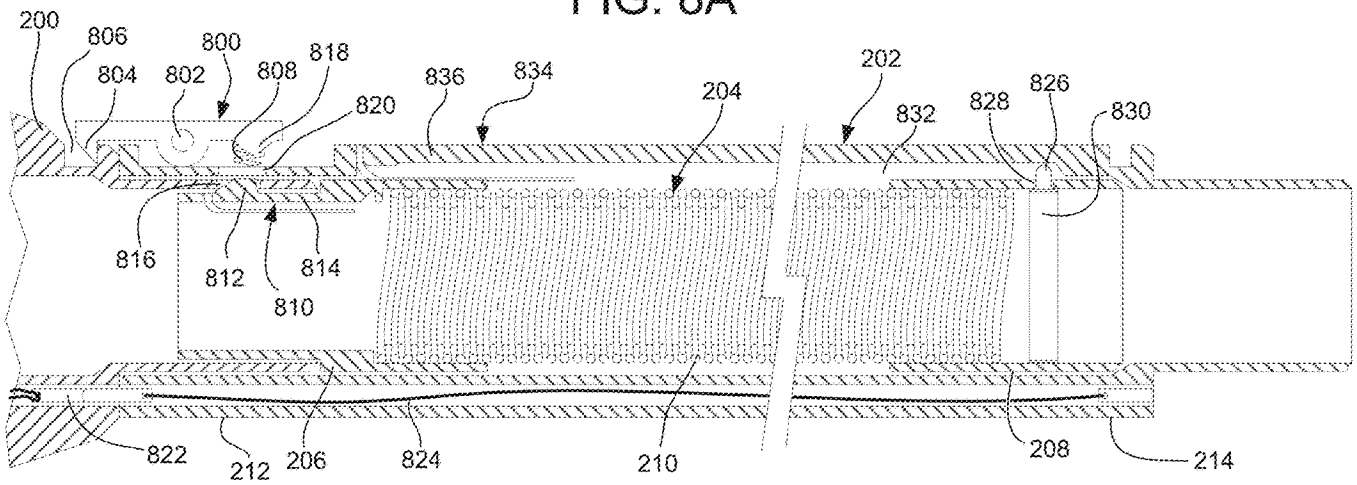
FIGS. 8A-8B show another embodiment of a wand assembly and associated parts of a vacuum cleaner, in two different configurations.
Figure 8B:
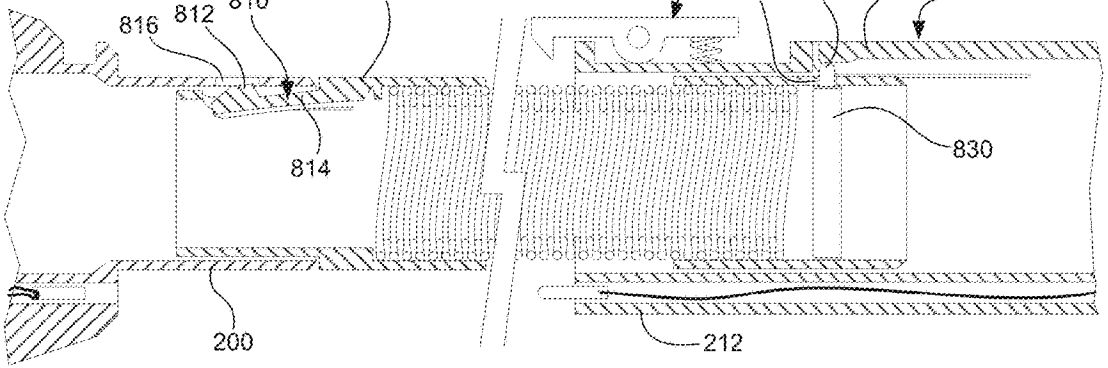

FIGS. 8A-8B illustrate an alternative embodiment, in which the rigid portion 202 of the wand assembly 104 is connected directly to the vacuum unit 102. Here, the proximal wand end 212 is configured to slide over the vacuum unit inlet 200. A first clasp 800 may be provided to hold the proximal wand end 212 in the attached position. For example, the first clasp 800 may be mounted to the proximal wand end 212 on a pivot 802, and include a hook 804 that engages a receptacle 806 on the vacuum unit inlet 200, and a spring 808 to bias the hook 804 into the receptacle 806. Pressing on the first clasp 800 above the spring 808 will move the hook 804 to disengage the receptacle 806, to allow the rigid portion 202 of the wand assembly 104 to be removed from the vacuum unit 102

The proximal hose end 206 of this embodiment comprises a hollow collar that slides inside the vacuum unit inlet 200. The proximal hose end 206 may be connected to the vacuum unit inlet 200 by a second clasp 810, such as a hook 812 that is resiliently mounted to the proximal hose end 206 on a cantilevered arm 814, and biased by the arm 814 into a receptacle 816 in the vacuum unit inlet 200. The arm 814 may be flexed by pushing on the hook 812 to displace the hook from the receptacle 816, such as shown in FIG. 8B, to remove the proximal hose end 206 from the vacuum unit 102.

The first clasp 800 also may include a projection 818 that is configured to pass through an opening 820 and contact the second clasp's hook 812 when the user pushes the first clasp 800 a certain distance. By doing this, the user can disengage the first clasp 800 and the second clasp 810 at the same time in order to remove the entire wand assembly 104 as a single unit. The distance may be selected to be greater than the distance required to disengage the first clasp's hook 804, so that pushing the first clasp 800 a first distance disconnects the rigid portion 202 from the vacuum unit 102, and pushing the first clasp 800 a greater second distance disconnects the rigid portion 202 and the flexible portion 204 from the vacuum unit 102. Alternatively, the first clasp 800 may not engage the second clasp 810, and the second clasp 810 may be accessible only after the rigid portion 202 of the wand assembly 104 is removed from the vacuum unit 102. This example is shown in FIG. 8B, which omits the projection 818 and opening 820. Other alternatives will be apparent to persons of ordinary skill in the art in view of the present disclosure.

This embodiment also does not require a separate electrical connector to pass through the proximal hose end 206. Instead, a first electrical connector 822 is provided in the vacuum unit 102, and this connects directly to a second electrical connector 824 in the rigid portion 202 of the wand assembly 104 when the proximal wand end 212 is connected to the vacuum unit inlet 200.

The distal wand end 214 preferably is configured to engage a base connector 122 to provide fluid and electrical communication to the base 106, and also may be connected to other accessory tools, such as discussed above. Other alternatives will be apparent to persons of ordinary skill in the art in view of the present disclosure.

The embodiment of FIGS. 8A-8B also illustrates an alternative arrangement for retaining the distal hose end 208 inside the rigid portion 202. Here, the distal hose end 208 comprises a button 826 that passes through and opening 828 through the sidewall of the distal hose end 208, and is mounted on a spring 830 such as a flexible piece of steel that generally conforms to the inner wall of the distal hose end 208. When the distal hose end 208 is located between the proximal wand end 212 and the distal wand end 214, the button 826 extends into a groove 832 formed in the inner wall of the rigid portion 202. The groove 832 terminates shortly before the proximal wand end 212, so that the button 826 prevents the distal hose end 208 from being retracted further than the end of the groove 832. When the distal hose end 208 is retracted to the proximal wand end 212, such as shown in FIG. 8B, the button 826 is located adjacent a third clasp 834 that is used to depress the button 826 against the bias of the spring 830 to allow the distal hose end 208 to be removed from the rigid portion 202 of the wand assembly 104. The third clasp 834 may comprise, for example, a resilient cantilevered arm 836 that is formed as part of the rigid portion 202, and that may be pressed inward to move the button 826 to the disengaged position. Other alternatives will be apparent to persons of ordinary skill in the art in view of the present disclosure.

Figure 9:
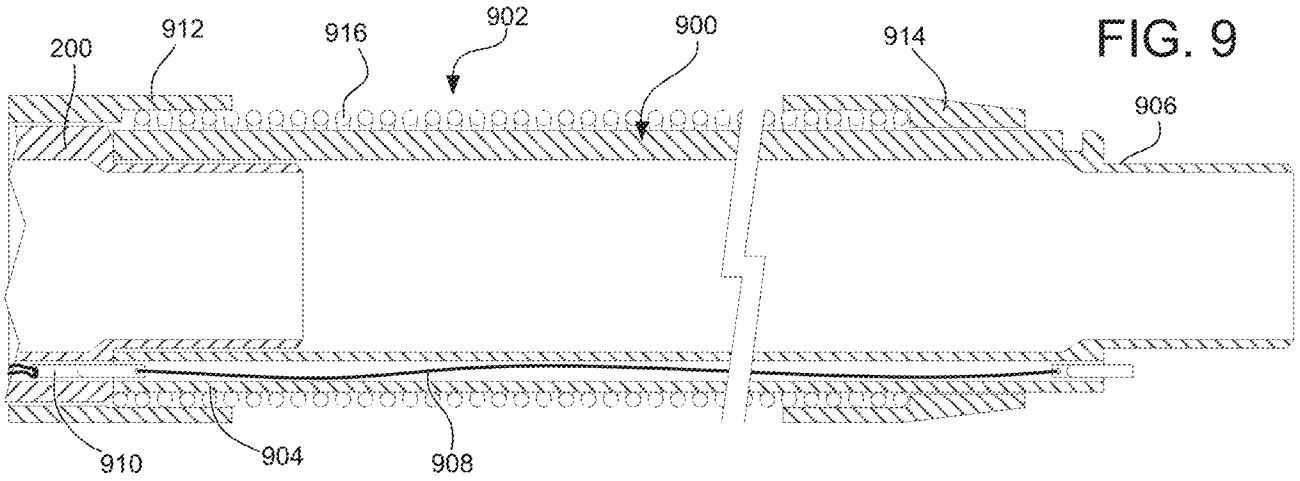
FIG. 9 shows another embodiment of a wand assembly and associated parts of a vacuum cleaner.

FIG. 9 illustrates another exemplary embodiment, in which the wand assembly 104 comprises a rigid portion 900 that fits telescopically inside a flexible portion 902. The rigid portion 900 has a proximal wand end 904 that attaches to the vacuum unit inlet 200, and a distal wand end 906 that extends outside the flexible portion 902. An electrical connector 908 extends along the rigid portion 900 to connect to a corresponding electrical connector 910 on the vacuum unit inlet 200. Any suitable clasp may be used to connect the rigid portion 900 to the vacuum unit inlet 200. For example, a rocker arm with a hook may be provided inside the vacuum unit inlet 200 to grasp the rigid portion. Such a device could be operated by a remote button through a pushrod or the like, and be enclosed in a housing to prevent contamination by incoming dirt. Alternatively, the proximal wand end 904 may comprise a bayonet-type fastener or a threaded fastener, to allow the rigid portion 900 to be removed by rotating it, relative to the vacuum unit inlet 200, about the rigid portion's longitudinal axis. These configurations would allow the rigid portion 900 to be released without releasing the flexible portion 902. Other alternatives will be apparent to persons of ordinary skill in the art in view of the present disclosure.

The flexible portion 902 has a proximal hose end 912 that is selectively connected to the vacuum unit inlet 200, a distal hose end 914 that slides over the rigid portion 900, and a flexible hose 916 connecting the proximal hose end 912 and the distal hose end 914. Any suitable clasp may be provided to hold the proximal hose end 912 to the vacuum unit inlet 200. An additional clasp may be provided to hold the distal hose end 914 in a particular location on the rigid portion 900, or to prevent the distal hose end 914 from passing over the proximal wand end 904 when the rigid portion 900 is slid out of the flexible portion 902. Persons of ordinary skill in the art will be able to incorporate a suitable clasp in view of the present disclosure.

In this example, the distal hose end 914 is larger than the distal wand end 906. Thus, the distal hose end 914 and distal wand end 906 may be configured to fit into different accessories having different interface sizes. However, accessories may be provided that can alternately receive both the distal hose end 914 and the distal wand end 906, or an adapter may be provided to allow such interchangeability.

Figure 10:
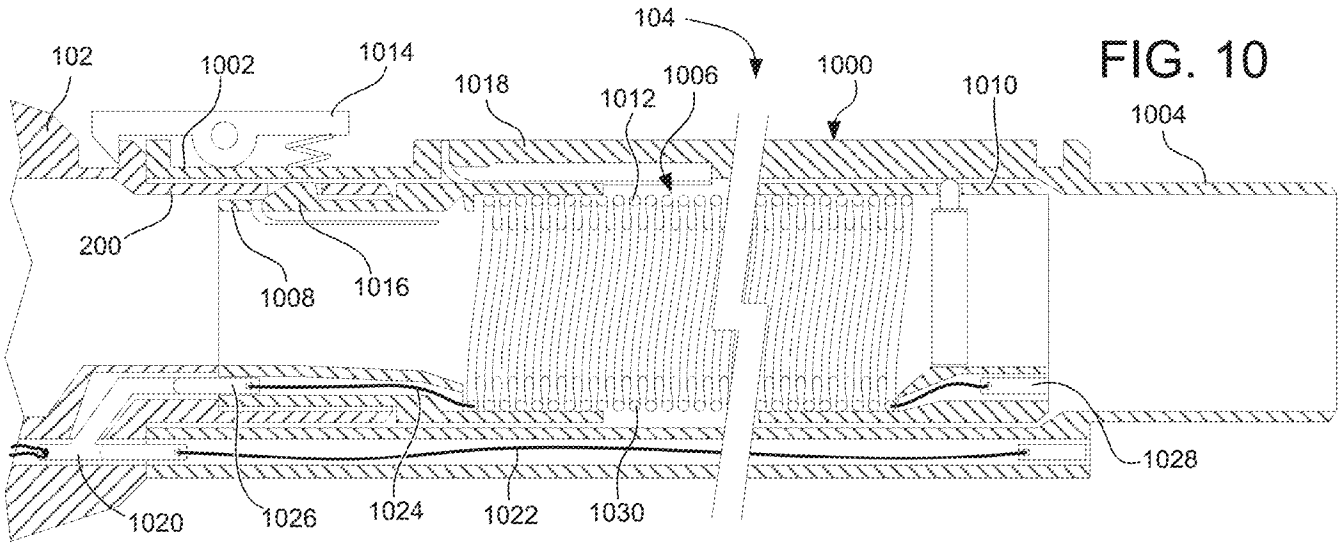
FIG. 10 shows another embodiment of a wand assembly and associated parts of a vacuum cleaner.

FIG. 10 illustrates another embodiment of a wand assembly 104 and its interface with a vacuum unit 102. This wand assembly 104 includes a rigid portion 1000 having a proximal wand end 1002 and a distal wand end 1004, as well as a flexible portion 1006 having a proximal hose end 1008, a distal hose end 1010, and a hose 1012 joining the proximal hose end 1008 to the distal hose end 1010. A first clasp 1014 joins the proximal wand end 1002 to the vacuum unit inlet 200, and a second clasp 1016 joins the proximal hose end 1008 to the vacuum unit inlet 200. A third clasp 1018 retains the distal hose end 1010 inside the rigid portion 1000 until it is desired to remove it.

The embodiment of FIG. 10 is similar to the one described in relation to FIGS. 8A-8B, but in this case the wand assembly includes electrical connectors through both the rigid portion 1000 and the flexible portion 1006. More specifically, the vacuum unit 102 includes a first electrical connector 1020 that connects a first location to a second electrical connector 1022 located in the rigid portion 1000, and at a second location to a third electrical connector 1024 located in the flexible portion 1006. The third electrical connector 1024 may include a first portion 1026 (e.g., a male plug) located in the proximal hose end 1008, a second portion 1028 (e.g., a female plug) located in the distal hose end 1010, and a flexible wire 1030 (or wires) joining the first portion 1026 and the second portion 1028. A suitable wire 1030 may be configured to extend through a coil of the hose 1012, as known in the art of electrified vacuum cleaner hoses, but other arrangements may be used.

The configuration of FIG. 10 is expected to be useful to extend the operability of electrically-powered accessories when the flexible portion 1006 is used without the rigid portion in place. Furthermore, an additional electrical connector may be provided to electrically connect the second electrical connector 1022 in the rigid portion 1000 to the second portion 1028 of the third electrical 1024 in the flexible portion 1006, in order to provide power when the wand assembly is used with the flexible portion 1006 telescopically extended from the rigid portion 1000. It will also be appreciated that similar modifications may be made to the other embodiments, such as the embodiment of FIGS. 7A-7C, to provide an electrical communication path from the vacuum unit 102 to the distal end of a flexible portion of a wand assembly. Other alternatives will be apparent to persons of ordinary skill in the art in view of the present disclosure.

Figure 11:
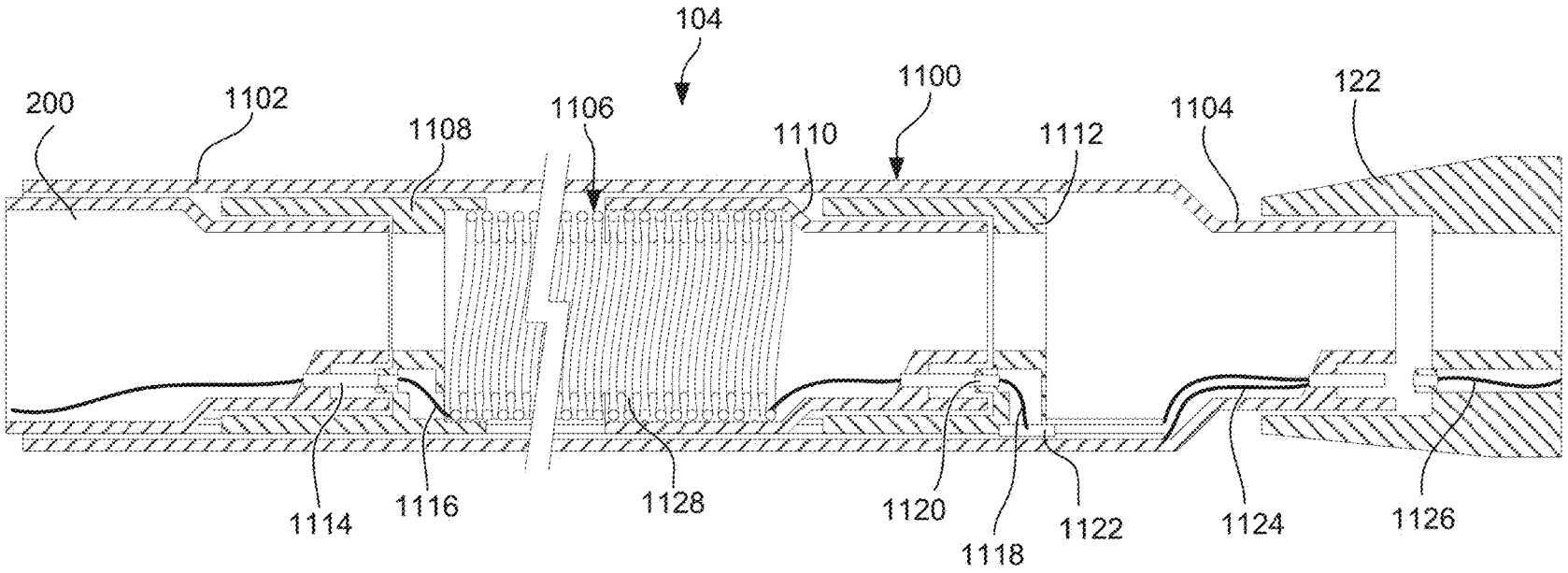
FIG. 11 shows another embodiment of a wand assembly and associated parts of a vacuum cleaner.

FIG. 11 provides a further embodiment in which both portions of the wand assembly 104 have electrical connectors. In this example, the wand assembly 104 has a rigid portion 1100 with a proximal wand end 1102 that attaches to the vacuum unit inlet 200 by any suitable connector, and a distal wand end 1104 that attaches to the base connector 122 (or other accessory) using any suitable connector. The wand assembly 104 also has a flexible portion 1106 that is telescopically received in the rigid portion 1100. The flexible portion 1106 has a proximal hose end 1108 that connects to the vacuum unit inlet 200, a distal hose end 1110 that is received within the rigid portion 1100, and a flexible hose 1128 joining the proximal hose end 1108 to the distal hose end 1110.

A sliding receptacle 1112 is located within and configured to slide along a predetermined length of the rigid portion 1100. For example, the sliding receptacle 1112 may have an outer profile that closely matches the inner profile of the rigid portion 1100, and may include low-friction surfaces to help smooth its sliding movement. One or more travel stops (not shown), such as a simple protrusion that contacts the sliding receptacle 1112 but not the distal hose end 1110, may be provided to prevent the sliding receptacle 1112 from being removed from the rigid portion 1100 while allowing the distal hose end 1110 to be removed. The sliding receptacle 1112 is configured to receive the distal hose end 1110, and provide fluid communication by way of one or more openings between the distal hose end 1110 and the distal wand end 1104. The sliding receptacle 1112 also may include a clasp or other mechanism (e.g., magnets) to hold the parts in engagement.

A first electrical connector 1114 is provided at the vacuum unit inlet 200. In this case, the first electrical connector 1114 is located within the air passage, but isolated therefrom by a housing to prevent dirt from fouling the electrical connector 1114. A second electrical connector 1116 is located in the flexible portion 1106, and extends from a first terminal at the proximal hose end 1108 to a second terminal at the distal hose end 1110. The second electrical connector 1116 may be incorporated into the coils of the hose 1128, as discussed above. The second electrical connector 1116 electrically connects to the first electrical connector 1114 when the proximal hose end 1108 is attached to the vacuum unit inlet 200.

A third electrical connector 1118 is provided in the sliding receptacle 1112. The third electrical connector 1118 has a first terminal 1120 that electrically connects to the second electrical connector when the distal hose end 1110 engages the sliding receptacle 1112. The third electrical connector 1118 also has a second terminal 1122 that engages a fourth electrical connector 1124 located in the rigid portion 1100 of the wand assembly 104. The second terminal 1122 and the fourth electrical connector 1124 may be provided as sliding electrical contacts that maintain electrical communication with one another regardless of where the sliding receptacle 1112 is located along the length of the rigid portion 1100. Alternatively, the second terminal 1122 may electrically connect to the fourth electrical connector 1124 when the sliding receptacle 1112 is at certain predetermined locations along the length of the rigid portion 1100. The fourth electrical connector 1124 extends to the distal wand end 1104, where it is electrically connected to a fifth electrical connector 1126 located in the base connector 122 or other accessory when the distal wand end 1104 is attached thereto.

The embodiment of FIG. 11 provides electrical communication from the vacuum unit 102 to the distal hose end 1110 when the flexible portion 1106 is removed from the rigid portion 1100, and also provides electrical communication to the distal wand end 1104 whenever the rigid portion 1100 is attached to the flexible portion 1106 (assuming the flexible portion is attached to the vacuum unit 102, of course). This embodiment also may be configured such that the vacuum unit inlet 200, distal wand end 1104 and distal hose end 1110 have similar or identical shapes, so that they may be interchangeably connected to the same accessories. In order to assure proper electrical connection between the distal hose end 1110 and the sliding receptacle 1112, the flexible portion 1106 may be configured to press tightly against the sliding receptacle 1112 when the flexible portion 1106 is fully collapsed into the rigid portion 1100. Other alternatives will be apparent to persons of ordinary skill in the art in view of the present disclosure.

The foregoing embodiments provide a number of examples of device configurations. It will be appreciated that these embodiments may be reconfigured such as by replacing features from one embodiment with those of another, or otherwise changing or modifying the embodiments. For example, in one embodiment, the electrical connectors may be entirely omitted from the wand assembly 104, so that it does not convey any electrical power to accessories. In other embodiments, the locations of the clasps may be reversed—for example, the first clasp 600 in FIG. 7A may be located on the vacuum unit 102 to engage a receptacle located in the proximal hose end 206, or the fourth clasp 736 may be located on the distal wand end 214 to engage a structure provided on the base connector 122. Also, the various parts may have various shapes. As examples, the rigid portion of the wand assembly may be curved along its longitudinal length, the parts of the wand assembly may have oval, round or other cross-sectional profiles, and the terminal ends of the flexible and rigid portions may be tapered, or comprise other shapes. Also, in other embodiments, the parts may not be separable. For example, in some embodiments, the distal hose end may not be removable from the rigid portion of the wand assembly, or the proximal hose end may not be removable from the vacuum unit. Other alternatives will be apparent to persons of ordinary skill in the art in view of the present disclosure.

It will also be understood that references that are incorporated herein by reference are incorporated for all of the teachings of each incorporated reference. Such incorporation is not limited to a particular feature that may be noted in the foregoing description.

The present disclosure describes a number of new, useful and nonobvious features and/or combinations of features that may be used alone or together. It will be also understood that the terms "and" and "or," as used herein, both mean "and/or." While certain features and advantages are described herein, it will be appreciated that the described features and advantages may not be present in every embodiment. The embodiments described herein are all exemplary, and are not intended to limit the scope of the inventions. It will be appreciated that the inventions described herein can be modified and adapted in various and equivalent ways, and all such modifications and adaptations are intended to be included in the scope of this disclosure and the appended claims.

We claim:

1. A vacuum cleaner comprising:

a vacuum unit having a housing, a power supply, a suction generator located in the housing, a dirt collector operatively associated with the housing, and a vacuum unit inlet in fluid communication with the dirt collector and the suction generator;

a wand assembly attached to and in fluid communication with the vacuum unit inlet, the wand assembly comprising:

a rigid portion having:

a proximal wand end, a distal wand end spaced along a longitudinal axis from the proximal wand end, and wherein the rigid portion is reconfigurable between a first wand condition in which the proximal wand end is rigidly connected to the vacuum unit inlet and the distal wand end is in fluid communication with the vacuum unit inlet, and a second wand condition in which the proximal wand end is movable relative to the vacuum unit inlet and the distal wand end is in fluid communication with the vacuum unit inlet;

a flexible portion having:

a proximal hose end configured to rigidly connect to the vacuum unit inlet with the proximal hose end in fluid communication with the vacuum unit inlet, a distal hose end configured to fit inside the rigid portion and be in fluid communication with the distal wand end, and a flexible hose fluidly connecting the distal hose end to the proximal hose end, the flexible hose being telescopically movable relative to the rigid portion between a first hose condition corresponding to the first wand condition in which the flexible hose is located entirely inside the rigid portion, and a second hose condition corresponding to the second wand condition in which at least a portion of the flexible hose adj acent the proximal hose end extends outside the rigid portion.

2. The vacuum cleaner of claim 1, wherein the vacuum unit further comprises a first electrical connector operatively associated with the power supply, and the proximal hose end further comprises a second electrical connector, wherein the second electrical connector is electrically connected to the first electrical connector when the proximal hose end is rigidly connected to the vacuum unit inlet.

3. The vacuum cleaner of claim 2, wherein the first electrical connector is operatively associated with the power supply through a user-operable switch.

4. The vacuum cleaner of claim 2, wherein the rigid portion comprises a third electrical connector that is electrically connected to the second electrical connector when the rigid portion is in the first wand condition.

5. The vacuum cleaner of claim 4, wherein the third electrical connector is not electrically connected to the second electrical connector when the rigid portion is in the second wand condition.

6. The vacuum cleaner of claim 1, wherein the proximal hose end is selectively removable from the vacuum unit inlet.

7. The vacuum cleaner of claim 6, further comprising an accessory having an accessory connector and an accessory inlet in fluid communication with the accessory connector, wherein the vacuum cleaner is reconfigurable between a first accessory condition in which the distal wand end is connected to the accessory connector with the accessory inlet in fluid communication with the vacuum unit inlet, and a second accessory condition in which the proximal hose end is removed from the vacuum unit inlet and the vacuum unit inlet is connected to the accessory connector without the wand assembly and with the accessory inlet in fluid communication with the vacuum unit inlet.

8. The vacuum cleaner of claim 7, wherein the vacuum cleaner is further reconfigurable to a third accessory condition in which the rigid portion is removed from the flexible portion and the accessory connector is connected to the distal hose end without the rigid portion and with the accessory inlet in fluid communication with the vacuum unit inlet.

9. The vacuum cleaner of claim 7, wherein:

the vacuum unit further comprises a first electrical connector operatively associated with the power supply;

the rigid portion comprises a second electrical connector; and the accessory connector comprises a third electrical connect;

wherein the second electrical connector is electrically connected to the first electrical connector when the proximal wand end is in the first wand condition, the third electrical connector is electrically connected to the second electrical connector when the accessory is in the first accessory condition, and the third electrical connector is electrically connected to the first electrical connector when the accessory is in the second accessory condition.

10. The vacuum cleaner of claim 7, wherein:

the vacuum unit further comprises a first electrical connector operatively associated with the power supply;

the proximal hose end further comprises a second electrical connector;

the rigid portion comprises a third electrical connector; and the accessory connector comprises a fourth electrical connector;

wherein the second electrical connector is electrically connected to the first electrical connector when the proximal hose end is rigidly connected to the vacuum unit inlet, the third electrical connector is electrically connected to the second electrical connector when the proximal wand end is in the first wand condition, the fourth electrical connector is electrically connected to the third electrical connector when the accessory is in the first accessory condition, and the fourth electrical connector is electrically connected to the first electrical connector when the accessory is in the second accessory condition.

11. The vacuum cleaner of claim 10, wherein the second electrical connector does not extend from the proximal hose end to the distal hose end.

12. The vacuum cleaner of claim 10, wherein the second electrical connector extends from the proximal hose end to the distal hose end, and the vacuum cleaner is further reconfigurable to a third accessory condition in which the rigid portion is removed from the flexible portion and the accessory connector is connected to the distal hose end without the rigid portion and with the accessory inlet in fluid communication with the vacuum unit inlet and the fourth electrical connector electrically connected to the second electrical connector.

13. The vacuum cleaner of claim 1, wherein the proximal wand end is rigidly connected to the vacuum unit by way of the proximal hose end when the rigid portion is in the first wand condition.

14. The vacuum cleaner of claim 13, further comprising a first clasp configured to selectively hold the proximal hose end to the vacuum unit inlet, and a second clasp configured to selectively hold the proximal wand end to the proximal hose end.

15. The vacuum cleaner of claim 1, wherein the proximal wand end is rigidly connected directly to the vacuum unit when the rigid portion is in the first wand condition.

16. The vacuum cleaner of claim 15, further comprising a first clasp configured to selectively hold the proximal hose end to the vacuum unit inlet, and a second clasp configured to selectively hold the proximal wand end to the vacuum unit inlet.

17. The vacuum cleaner of claim 1, wherein the distal hose end is slidable within the rigid portion between a first position in which the distal hose end is adjacent the distal wand end and a second position in which the distal hose end is adjacent the proximate wand end.

18. The vacuum cleaner of claim 17, further comprising a clasp configured to selectively prevent the distal hose end from passing through the proximate wand end.

19. The vacuum cleaner of claim 1, wherein the wand assembly is selectively removable from the vacuum unit.

20. The vacuum cleaner of claim 1, wherein the power supply comprises at least one of a power cord and a battery.

* * * * *